US010136232B2

(12) United States Patent
Karamuk et al.

(10) Patent No.: US 10,136,232 B2
(45) Date of Patent: Nov. 20, 2018

(54) TRANSDUCER PROTECTION SYSTEM, HEARING DEVICE AND USAGE OF A TRANSDUCER PROTECTION SYSTEM

(71) Applicant: Sonova AG, Stafa (CH)

(72) Inventors: Erdal Karamuk, Mannedorf (CH); Josef Mueller, Feusisberg (CH); Andi Vonlanthen, Oberrohrdorf (CH); Thomas Jenni, Kusnacht (CH)

(73) Assignee: SONOVA AG, Stäfa (CH)

( * ) Notice: Subject to any disclaimer, the term of this patent is extended or adjusted under 35 U.S.C. 154(b) by 0 days.

(21) Appl. No.: 15/517,565

(22) PCT Filed: Oct. 15, 2014

(86) PCT No.: PCT/EP2014/072112
§ 371 (c)(1),
(2) Date: Apr. 7, 2017

(87) PCT Pub. No.: WO2016/058638
PCT Pub. Date: Apr. 21, 2016

(65) Prior Publication Data
US 2017/0318404 A1 Nov. 2, 2017

(51) Int. Cl.
*H04R 25/00* (2006.01)
*H04R 1/10* (2006.01)

(52) U.S. Cl.
CPC ..... *H04R 25/654* (2013.01); *H04R 25/604* (2013.01); *H04R 1/1016* (2013.01); *H04R 2460/17* (2013.01)

(58) Field of Classification Search
CPC .... H04R 25/60; H04R 25/65; H04R 2460/17; H04R 2225/023; H04R 2225/025; H04R 2460/13; H04R 2201/10
USPC ..... 381/322, 324–325, 328, 380
See application file for complete search history.

(56) References Cited

U.S. PATENT DOCUMENTS 1,683,316 A * 9/1928 Von Suchorzynski ..... A61F 11/008 114/221 R
4,972,488 A 11/1990 Weiss
5,099,947 A 3/1992 Guggenberger
6,671,381 B1 12/2003 Lux-Wellenhof
6,724,902 B1 * 4/2004 Shennib ..... H04R 25/456 381/322
6,891,956 B2 5/2005 Heerlein
7,751,579 B2 7/2010 Schulein
7,793,756 B2 9/2010 Karamuk
8,019,106 B2 9/2011 Gunnersen
(Continued)

FOREIGN PATENT DOCUMENTS

DE 37 36 591 A1 11/1988
EP 0 310 866 B1 4/1989
(Continued)

OTHER PUBLICATIONS

International Search Report for PCT/EP2014/072112 dated Jul. 1, 2015.
Written Opinion for PCT/EP2014/072112 dated Jul. 1, 2015.

*Primary Examiner* — Suhan Ni
(74) *Attorney, Agent, or Firm* — Pearne & Gordon LLP

(57) ABSTRACT

A transducer protection system for the protection of at least one transducer opening in a housing of a hearing device, including a support and a plurality of fibers each fixed at one end to the support and free to move on the other end.

15 Claims, 4 Drawing Sheets

(56) References Cited

U.S. PATENT DOCUMENTS

| | | | | |
|---|---|---|---|---|
| 2007/0223759 | A1 | 9/2007 | Ach-Kowalewski | |
| 2009/0028356 | A1* | 1/2009 | Ambrose | H04R 1/1016 381/71.6 |
| 2011/0019851 | A1 | 1/2011 | Michel | |
| 2014/0239634 | A1 | 8/2014 | Michel | |

FOREIGN PATENT DOCUMENTS

| | | | |
|---|---|---|---|
| WO | 93/12626 | A1 | 6/1993 |
| WO | 2005/096671 | A1 | 10/2005 |

* cited by examiner

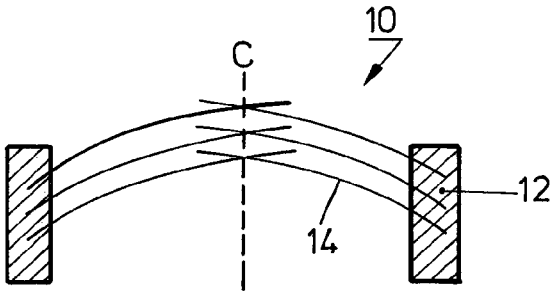
FIG. 1a
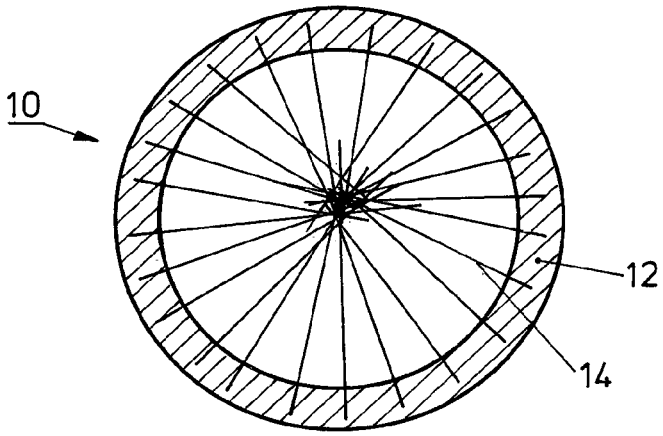
FIG. 1b
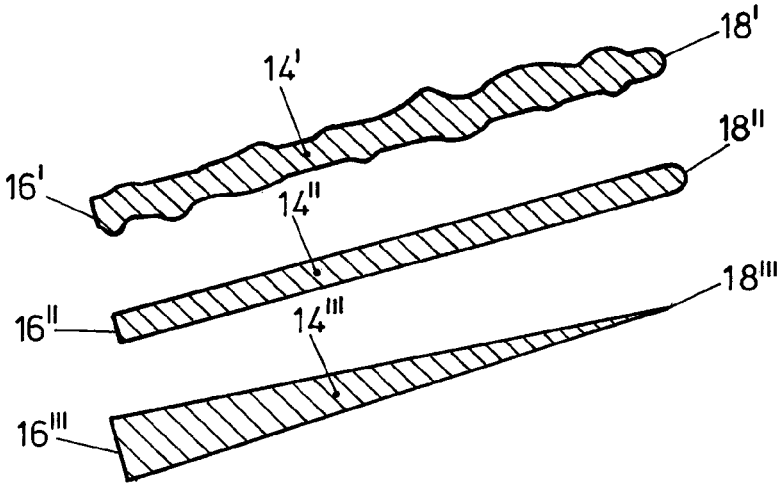
FIG. 2a
FIG. 2b
FIG. 2c

TRANSDUCER PROTECTION SYSTEM, HEARING DEVICE AND USAGE OF A TRANSDUCER PROTECTION SYSTEM

TECHNICAL FIELD

The present invention is related to a transducer protection system, a hearing device as well as a usage of a transducer protection system.

BACKGROUND OF THE INVENTION

Hearing devices are typically small ear-level devices used to improve the hearing capability of hearing impaired people. This is achieved by picking up the surrounding sound with a microphone of a hearing device, processing the microphone signal thereby taking into account the hearing impairment of the user of the hearing device and providing the processed sound signal into an ear canal of the user via a miniature loudspeaker, commonly referred to as a receiver.

In particular, relating to in-the-ear (ITE) hearing devices, the problem exists that in an acoustic output or rather acoustic output opening towards the inner ear of the user, contamination can occur, in particular caused by cerumen. Also the acoustic input of a hearing device is exposed to dirt. In the context of the present invention both microphones and receivers are denoted as transducers.

Transducer protection systems used to protect against entrance of cerumen are known. The working principle of these systems is a mechanical grid (a fabric, molded structure, porous membrane) that covers the acoustic output opening of a hearing device. In the state of the art as disclosed in EP 0 310 866 B1, measures are known to prevent or at least to reduce essentially the contamination by cerumen of an in-the-ear (ITE) hearing device by using a membrane as ear piece protection. A cerumen protection system based on a microporous membrane is disclosed that is mounted into a cap which can be fixed onto the output opening of the ITE or earmold.

Document U.S. Pat. No. 6,891,956 B2 describes a membrane-based protection device for an ITE, wherein the membrane is removable for cleaning and arranged basically in a parallel fashion to the axis of the ear canal. Document U.S. Pat. No. 7,751,579 B2 describes a membrane-based barrier used to protect the sound exit or entrance of an acoustic device. This barrier is formed by a non-rigid, non-tensioned film that basically reradiates sound from the acoustic device. Document U.S. Pat. No. 7,793,756 describes a replaceable protection membrane for hearing devices based on an elastomeric foil of constant thickness that is mounted onto a plastic carrier ring by bonding or welding.

Document DE 3 736 591 A1 describes a labyrinth-like structure for a cerumen filter involving radial wires that are fixed in the center and fixed to the outer edge like spokes in a wheel. Document WO 93/12626 describes a cerumen protection patch that can be fixed onto the hearing device shell. This patch has a central porous part covering the sound exit consisting of an open porous foam or a non-woven textile. Document U.S. Pat. No. 5,099,947 describes a coil-like wax filter that can be inserted into the sound exit of a hearing device and is interference-fitted. This coil comprises a wire wound in a spiral path such as to cover a large area of the sound exit. This system needs to be removed for cleaning by using tweezers or any other tool suitably for removing. Document WO 2005/096 671 A1 describes a cerumen guard for a hearing device comprising a chamber adapted to accommodate various different filters depending on the respective user needs. This arrangement serves to block cerumen from entering into the receiver. Further solutions are proposed in U.S. Pat. No. 6,671,381 B1; U.S. Pat. No. 8,019,106 B2; and US 2007/0223759 A1.

In the state of the art, problems arise in that any attempt to clean protection systems comprised by a porous filter or foam will result in that cerumen is pressed further into the pores of the filter or foam. A further problem is that cerumen and/or debris might accumulate on the surface of the device, which only can be cleaned by wiping involving the risk of damaging the membrane. Due to this, cleaning imposes a difficulty for hearing device users. Further, in the state of the art, cleaning of protection systems involves the risk of damaging thereof.

It is an object of the present invention to provide a transducer protection system and hearing device solving the problems in the state of the art.

SUMMARY OF THE INVENTION

The present invention is directed to a transducer protection system for the protection of at least one transducer opening in a housing of a hearing device, comprising a supporting means and a plurality of fibers, each fixed at one end to the supporting means and free to move on the other end. The inventive transducer protection system protects against entrance of cerumen and/or debris particles or other dirt via the at least one transducer opening in the hearing device. Cleaning of the inventive transducer protection system is easy and free of the risk of damaging thereof. Advantageously, the transducer protection system is small in size, providing maximized anatomic fit rate. Hence, the system can be fitted into the sound exit of miniaturized ITE hearing devices. It can be fitted also into the sound entrance of a hearing device. Advantageously, the acoustic characteristics of the hearing device is not imposed to any distortion. The inventive transducer protection system does not impact the frequency response of the receiver or the microphone of the hearing device over the whole frequency range, for example 100 Hz to 8 kHz at maximum power output MPO.

In an embodiment of the proposed transducer protection system the supporting means comprises a carrier ring, wherein the fibers are fixed along the inner race thereof, circumferentially, such to be directed to the center of the carrier ring. Hence, the transducer protection system can be cleaned easily by the user, whereby still restoring its full functionality without the necessity to be exchanged. The transducer protection system can be cleaned easily due to the fact that the individual fibers can be bent to allow a cleaning tool, for example a brush with a thin cylindrical body and a cleaning tip, to be inserted into the opening and retrieved without damaging the system. Cerumen and debris are entrapped in the fibers of the transducer protection system like in cilia in a natural orifice. To clean the transducer protection system, the cleaning tool is axially introduced into the opening of the transducer protection system. In doing so, the fibers bend down and thus allow the cleaning tool to engage the cerumen, debris and/or dirt particles entrapped by the fibers.

In a further embodiment of the proposed transducer protection system the carrier ring is adapted to be fixedly inserted by its outer race into the transducer opening of the hearing device. Therefore, the transducer protection system can be inserted into the transducer opening of the hearing device easily. Additionally, the transducer protection system can be removed easily, for example due to external cleaning or exchange.

In a further embodiment of the proposed transducer protection system the fibers are fixed to the inner race such to originate across at least a portion along the axis of the carrier ring. The transducer protection system comprises a brush-styled arrangement of fibers that are fixed at one end and free to move on the other end like cantilevers. Compared to the state of the art in which a static grid or screen is used, the transducer protection system according to the present invention provides various advantages. One of these advantages relies in that the transducer protection system makes it particularly easy to be cleaned. This is due to the fact that the individual fibers can bend up and down to allow a cleaning tool to be inserted into the opening. Further, limitation of acoustic transparency, i.e. high damping and high distortion, for high sound pressure levels, which limitation is common in the state of the art, is omitted.

In a further embodiment of the proposed transducer protection system the length of the fibers is chosen such to exceed the radius of the carrier ring. Therefore, the fibers cross each other in a center portion of the carrier ring resulting in that the center portion has the highest density of fibers.

In a further embodiment of the proposed transducer protection system the fibers are arranged such that distal end portions thereof overlap each other in at least a center portion of the carrier ring. Hence, the density distribution increases towards the center portion of the carrier ring which provides improved trapping of cerumen and debris particles.

In a further embodiment of the proposed transducer protection system the supporting means comprises a central shaft, wherein the fibers are fixed to the central shaft such to protrude radially thereof, and wherein the supporting means is adapted to be inserted into the transducer opening such to be aligned to the center axis of the transducer opening. In this embodiment, the fibers of the transducer protection system are protruding radially from the central shaft which itself is connected to or part of the supporting means. This allows the transducer protection system to be placed directly inside the transducer opening of the hearing device. As the fibers can be bent or rather deflected easily upon radial pressure, geometric tolerances can be compensated. Therefore, usage of a bushing to be placed into the transducer opening of a hearing device, which tolerances must match those of the respective opening of the hearing device, can be omitted. If a bushing dimension of a transducer protection system is not well balanced, there is a risk that the transducer protection system will fall out during use. Otherwise, a high force is needed for insertion which can either damage the transducer protection system and/or is difficult to handle. Further, usage of a bushing can be avoided which would otherwise decrease transducer opening area.

In a further embodiment of the proposed transducer protection system the fibers are fixed to the central shaft such to originate across at least a portion of the axis thereof. An advantage of the proposed solution according to this embodiment is the large range of transducer opening diameters it can fit into. Therefore, it is possible to omit usage of a bushing. Further, the transducer protection system can be placed safely and directly into the transducer opening. Advantageously, because of the plurality of fibers can be bent upon radial pressure, the axial force applied to the transducer opening during insertion and removal of the transducer protection system can be decreased. Therefore, damaging of the transducer opening can be omitted. Further, usage of an adhesion bonded interface to the shell of the hearing device can be omitted resulting in reduced manufacturing time, less maintenance and reduced costs.

In a further embodiment of the proposed transducer protection system the distribution density of the fibers along the axis of the central shaft is decreasing towards the distal end thereof. In this embodiment, the transducer protection system comprises a gradient in fiber density (fibers per volume) along its axis. In this way, the fiber density is increased towards the outlet of the transducer opening. Therefore, clogging dynamics of the transducer protection system can be optimized.

In an embodiment of the proposed transducer protection system the length of the fibers is chosen such to exceed the radius of the transducer opening. This allows for proper insertion and removal of the transducer protection system without damaging the inner race of the transducer opening. Further, usage of a bushing can be avoided which would otherwise decrease transducer opening area.

In a further embodiment of the proposed transducer protection system the supporting means further comprises a carrier structure supporting the central shaft, adapted to couple the central shaft to at least a portion of the hearing device. The carrier structure can be a stiff and acoustic transparent carrier structure that protrudes radially further as compared to the fibers in order to assure that the protection system cannot be pushed too deep into the transducer opening.

In a further embodiment of the proposed transducer protection system the carrier structure is adapted to abut on at least a portion of the outer periphery of the transducer opening. For example, the carrier structure can be realized such to assume the form of a ring or a cross, wherein in each example the central shaft being supported in the center portion thereof. Hence, a transducer protection system is provided, which is small in size and does not impose distortion to the acoustic transparency. Further, the transducer protection system provides improved protection against moisture, water, cerumen, etc. Furthermore, the transducer protection system can be cleaned and exchanged easily requiring less time.

In a further embodiment of the proposed transducer protection system the distal ends of the fibers are adapted to get stuck by the transducer opening wall such to fixedly mount the supporting means to the housing of the hearing device. In order to improve the ability of the fibers to get stuck by the transducer opening wall, this wall can be formed to be coarse and/or to comprise indentations to better allow the distal ends of the fibers get stuck by the transducer opening wall. Hence, unintentional removing of the transducer protection system out of the transducer opening can be avoided.

In an embodiment of the proposed transducer protection system the fibers are monofilament fibers.

In a further embodiment of the proposed transducer protection system a hydrophobic coating is applied to the fibers, preferably a hydrophobic polymer coating. Therefore, resistance against water and oily cerumen can be further improved. The hydrophobic coating can be applied by chemical vapor deposition (CVD) coating technology, allowing to deposit a thin (<100 nm) hydrophobic polymer coating conformably onto the substrate.

In a further embodiment of the proposed transducer protection system the cross section of the fibers varies along the main axis thereof. By providing the fibers such that the cross section thereof varies along the main axis, optimal adaptation to a given protection task is allowed. In addition to varying the geometry of each single fiber, fibers of different geometries can be combined in order to provide a further optimal adaptation to a given task.

Moreover, the present invention is directed to a hearing device exhibiting the advantages of the proposed transducer protection system. The proposed hearing device comprises a housing and at least one transducer provided into the housing, wherein the housing comprises at least one transducer opening, each exposing the at least one transducer to the outside, further comprising at least one transducer protection system mounted to the at least one transducer opening.

Hence, a hearing device is proposed comprising excellent protection against moisture and water as well as against cerumen and debris particles. Further, the hearing device can be cleaned easily within a reduced time period without damaging thereof.

Moreover, the present invention is directed to a usage of a transducer protection system for the protection of at least one transducer opening in a housing of a hearing device against the entrance of at least cerumen and/or debris particles.

BRIEF DESCRIPTION OF THE DRAWINGS

The present invention is further described with reference to the accompanying drawing jointly illustrating various exemplary embodiments which are to be considered in connection with the following detailed description. What is shown in the Figures is the following:

FIGS. 1*a,b* are schematically views of a transducer protection system according to a first embodiment in a cross sectional view and in a top view;

FIGS. 2*a-c* are schematically views of different fiber geometries;

DETAILED DESCRIPTION OF THE INVENTION

Figure 3A:
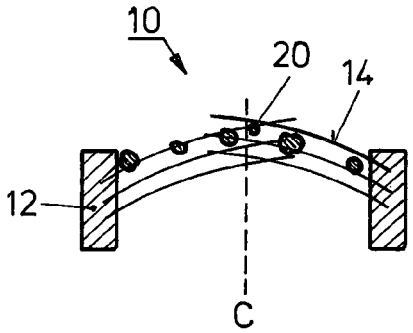
FIGS. 3*a,b* are schematically views of a cleaning process for the transducer protection system according to the first embodiment.
Figure 3B:
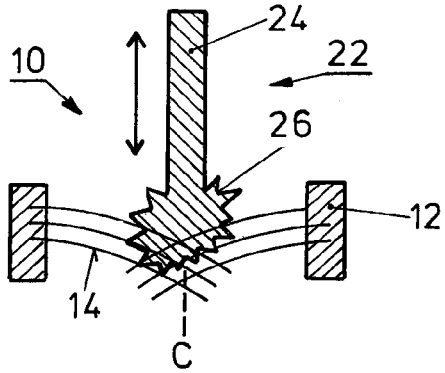

FIGS. 1*a,b* are schematically views of a transducer protection system 10 according to a first embodiment in a cross sectional view along the axis thereof and in a top view. The transducer protection system 10 comprises a supporting means 12 and a plurality of fibers 14, each fixed at one end to the supporting means 12 and free to move on the other end. In this embodiment, the supporting means 12 comprises an annular means. The plurality of fibers 14 are fixed to the annular supporting means 12 such to protrude radially towards the center of the annular supporting means 12. These fibers 14 can be made shorter (not shown) or longer than the radius of the annular supporting means 12. In case of each or at least a part of the fibers 14 are longer than the radius of the annular supporting means 12, these fibers 14 will cross each other in the center C region of the annular supporting means 12. Thus, the center C region has the highest density of fibers 14.

The fibers 14 can be made straight or curved depending on the respective design of the transducer protection system 10. Further, the density of the fibers 14 can be varied depending on the respective application. While a high density of fibers 14 enhances the ability to protect against entrance of cerumen or debris particles, the respective placement of the fibers 14 has to be selected in view of the required acoustic transparency of the transducer protection system 10. This tradeoff between protection mechanism and acoustic transparency can be selected depending on the desired application. The shown assembly of the fibers 14 serves reliably as barrier against entrance of cerumen and/or debris particles.

FIGS. 2*a-c* are schematically views exemplifying different geometries of respective fibers 14'-14'''. In particular, examples of different fiber geometries that could be used in the present invention are shown. The geometry of each single fiber can be varied or fibers of different geometries can be combined for an optimal adaptation to a given task. The fibers 14'-14''' are shown schematically having a fixed end 16'-16''' and a free end 18'-18'''. The cross section of each fiber can vary along its main axis in adaptation to different tasks.

In the case shown in FIG. 2*a*, the fiber 14' is irregular in cross section, leading to a high specific surface area. In combination with a hydrophobic coating, this fiber 14' geometry has a high degree of hydrophobicity and oleophobicity. In particular, in order to further improve resistance against water and oily cerumen, the hydrophobic coating can be applied to the fibers. As to the coating, for example by a CVD (Chemical Vapor Deposition) coating technology, a thin (<100 nm) hydrophobic polymer coating is deposited conformably onto the substrate of the fibers. As the coating is applied from the vapor phase, highly porous structures such as the proposed fiber assembles can be conformably coated easily.

In the example shown in FIG. 2*b*, the fiber 14'' is cylindrical and straight in shape, serving to achieve a transducer protection system having high degree of prediction and control of mechanical properties.

The fiber 14''' exemplified in FIG. 2*c* becomes thinner towards the free end 18''' thereof. Advantageously, due to this configuration, if the fiber density is high, the amount of fiber material in the center of the transducer protection system can be reduced.

FIGS. 3*a,b* depict a cleaning process for the transducer protection system 10 according to the first embodiment. The transducer protection system 10 according to the first embodiment can be cleaned very easily from cerumen and/or debris particles 20. As can be best seen in FIG. 3*a*, cerumen and/or debris particles 20 get entrapped in the fibers 14 of the transducer protection system 10 like in cilia in natural orifice. Advantageously, due to the fact that the individual fibers 14 can be bent, a cleaning tool 22 such as a brush is allowed to be inserted into the opening and retrieved without damaging the transducer protection system 10. If cleaning becomes necessary, the cleaning tool 22 having a thin cylindrical body 24 and a cleaning tip 26 can be axially introduced into the opening of the transducer protection system 10.

In doing so, the fibers 14 will bend down, allowing the cleaning tool 22 to engage the cerumen and/or further debris particles 20. The cleaning tip 26 can be realized by a brush itself having small monofilament fibers as known for dental applications, for example intra dental brushes. In another example, the cleaning tip 26 can be realized by a fiber assembly of non-woven fibers such as a small Q-tip or a microbrush.

Figure 4A:
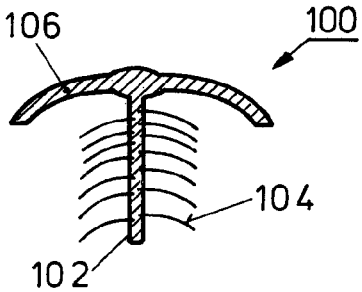
FIGS. 4*a-c* are schematically views of a transducer protection system according to a second embodiment in a cross sectional view and in a top view.
Figure 4B:
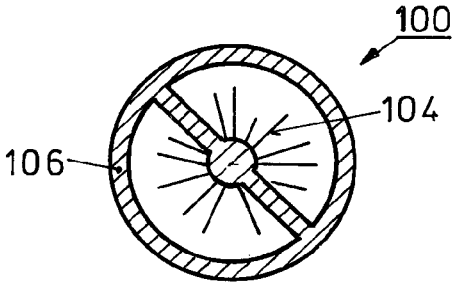
Figure 4C:
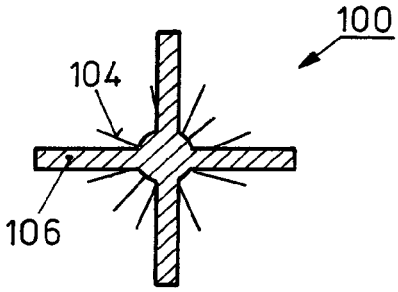

FIGS. 4*a-c* show a transducer protection system 100 according to a second embodiment in a side view and in a top view. As best shown in FIG. 4*a*, the transducer protection system 100 comprises a central shaft 102 elongated such to fixedly support a plurality of fibers 104. The fibers 104 are fixed along and around the central shaft 102 such to protrude radially thereof. Therefore, due to radial pressure of the fibers 104 the central shaft 102 can be inserted into a transducer opening of a hearing device (not shown) such to be aligned to the center axis thereof.

A carrier structure 106 is provided for supporting the central shaft 102 in order to couple the central shaft 102 to at least a portion of a hearing device (not shown). The central shaft 102 is supported by the carrier structure 106 in the center thereof such that the axis of the central shaft 102 and the plane of the carrier structure 106 are perpendicular to each other.

As best shown in the top views as depicted in FIGS. 4*b* and 4*c*, the carrier structure 106 protrudes radially further than the fibers 104 in order to prohibit the transducer protection system 100 to be pushed into the transducer opening (not shown) too deep. Further, as best shown in FIGS. 4*b* and 4*c*, the carrier structure 106 is formed such to be acoustically transparent. Therefore, in a first alternative, the carrier structure 106 can be realized as a ring with a central strut, as schematically shown in FIG. 4*b*. As an alternative, the carrier structure 106 can be formed cross-like, as schematically shown in FIG. 4*c*. The carrier structure 106 can be made from an injection molded thermoplastic part, for example. While not shown, a variety of other designs are possible in order to allow that the transducer protection system 100 is proper supported into a transducer opening.

Compared to the transducer protection system 10 according to the first embodiment (refer to FIG. 1), in the transducer protection system 100 according to the second embodiment, the fibers 104 are protruding radially from the central shaft 102 which itself is connected to the carrier structure 106. Therefore, the transducer protection system 100 can be placed easily into the sound opening of a hearing device (not shown). As the fibers 104 can be bent and deflected easily upon radial pressure, the transducer protection system 100 can compensate for any geometric tolerances. Therefore, bushings used to be placed into the transducer opening can be omitted. According to the second embodiment, tolerances between the transducer protection system and the transducer opening are rendered irrelevant. Hence, according to the second embodiment, there is no risk that the transducer protection system 100 may fall of the transducer opening and drop into the ear canal of the user. Further, applying a high force in order to insert the transducer protection system into a transducer opening can be omitted.

The transducer protection system 100 as shown in FIG. 4*a* comprises a gradient in fiber density (fibers per volume) along the axis of the central shaft 102. Therefore, clogging dynamics of the transducer protection system 100 can be optimized. In other words, the distribution density of the radially protruding fibers 104 can be made varying over the length of the central shaft 102 thus creating a fiber gradient. Depending on the respective application, this gradient can be made increasing or decreasing towards the distal end of the central shaft 102.

Figure 5:
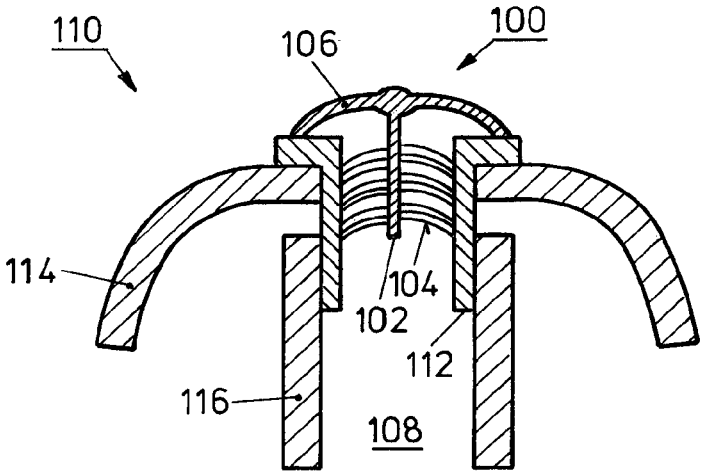
FIG. 5 is a schematically cross sectional view of the transducer protection system according to the second embodiment inserted into a transducer opening of a hearing device in a first example.

FIG. 5 schematically depicts the transducer protection system 100 inserted into a transducer opening 108 of a hearing device 110. The fibers 104 of the transducer protection system 100 are protruding radially from the central shaft 102 which is fixed to the carrier structure 106 or integrally molded therewith. When the transducer protection system 100 is fixed into the transducer opening 108, the carrier structure 106 becomes to abut against or rather rest on a bushing 112 which is glued into the shell 114 of the hearing device 110. The bushing 112 is connected to the inner race of a wall 116 of the transducer opening 108 which itself connects a transducer (not shown) of the hearing device 110 to the outside.

Figure 6:
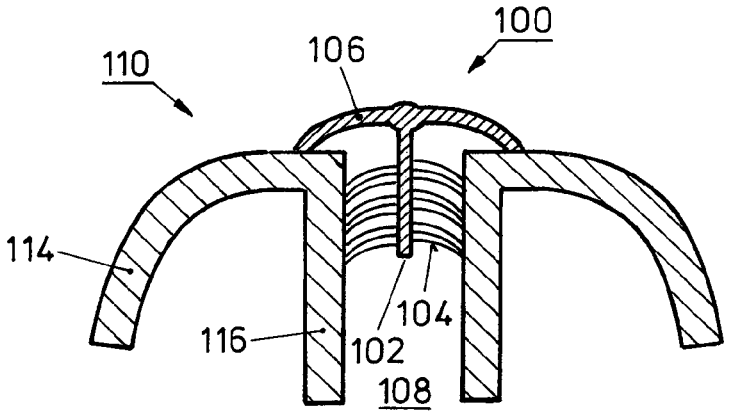
FIG. 6 is a schematically cross sectional view of the transducer protection system according to the second embodiment inserted into a transducer opening of a hearing device in a second example.

FIG. 6 shows the arrangement shown in FIG. 5, wherein a bushing (bushing 112, refer to FIG. 5) is omitted. In the example shown in FIG. 6, the transducer protection system 100 is safely and directly placed into the transducer opening 108. As the plurality of fibers bend upon radial pressure, axial force applied to the wall 116 of the transducer opening 108 during insertion and removal of the transducer protection system 100 is decreased, minimizing the possibility to damage the adhesion bonded interface to the shell 114. The inner race of the wall 116 of the transducer opening 108 can be made of rubber, for example. One major advantage of the exemplary embodiment as shown in FIG. 6 relies on the possibility to maintain the diameter of the transducer opening 108 maximal. Therefore, acoustic transparency can be increased.

Figure 7:
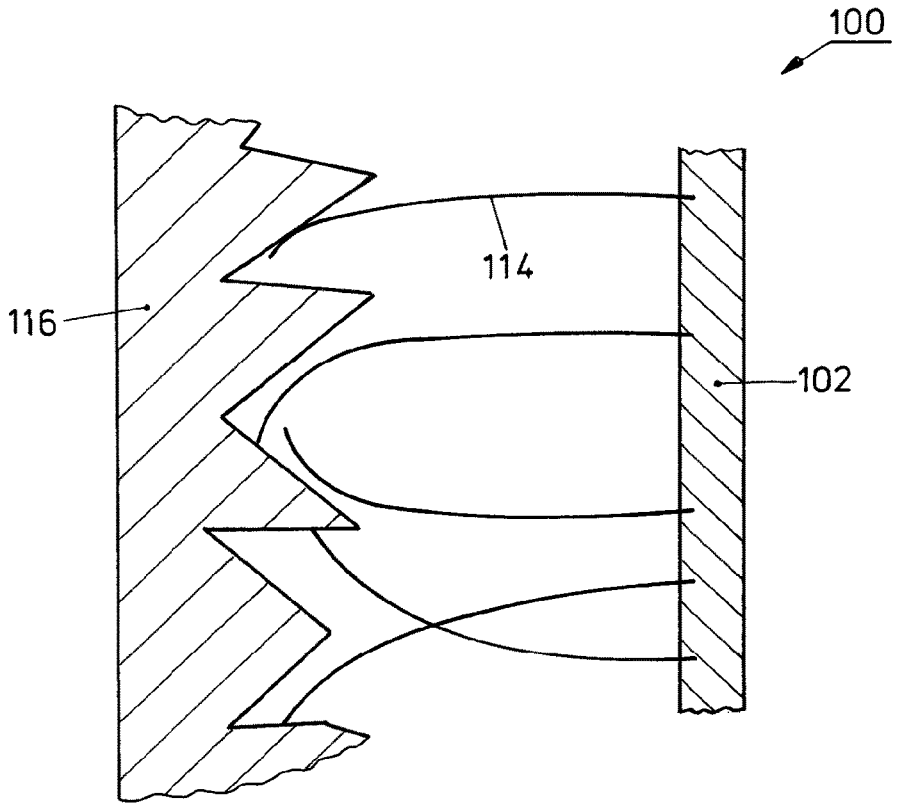
FIG. 7 is an enlarged view of the transducer protection system according to the second embodiment inserted into the transducer opening exemplifying the fibers getting stuck.

FIG. 7 schematically shows the engagement of the fibers 114 with the wall 116 of the transducer protection system 100 shown in FIG. 6 in an enlarged view. As schematically depicted, the inner race of the wall 116 of the transducer opening 108 is formed such to comprise a rough surface. Optionally or as an alternative, the inner race surface of the wall 116 can be formed sawtooth-like. Therefore, the distal ends of the fibers 114 are allowed to get stuck or rather properly engaged by the wall 116 of the transducer opening 108 such to fixedly mount the central shaft 102 to the wall 116 or rather the housing of the hearing device. Therefore, unintentional removal of the transducer protection system 100 from the transducer opening 108 can be omitted. Increasing the friction between the transducer protection system 100 and the wall 116 results to increased retention forces.

Figure 8:
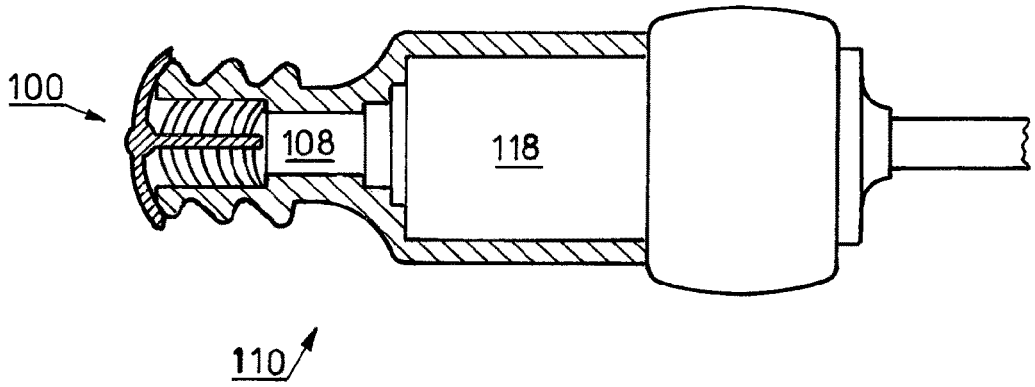
FIG. 8 shows a hearing device provided with a transducer protection system according to the second embodiment.

FIG. 8 is a schematic view of the hearing device 110 equipped with the transducer protection system 100 according to the second embodiment. The hearing device 110 accommodates a transducer 118. Further comprised is a transducer opening 108 exposing the transducer 118 to the outside. Advantageously, the transducer 118 is protected by the transducer protection system 100 against entrance of cerumen and/or debris particles. Further, the fibers of the transducer protection system 100 can be cleaned easily, for example by means of a brush, without damaging the transducer protection system 100 or the hearing device 110 itself.

Further, the transducer protection system 100 can be exchanged easily, for example in case of a retrofit, in which a user wants to change the transducer protection system 100 because of its acoustic transparency. This acoustic transparency results from the 3-dimensional arrangement of the fibers and the relatively large space between single fibers. Additionally, in case of any disconnected fibers, this will not result in vibrational modes as known from membranes, which could lead to additional distortions. Due to its large specific surface area, the proposed transducer protection system is—in combination with a hydrophobic CVD coating—very resistant against liquids and droplets. As the porosity can be controlled easily by means of adjusting the density of the fibers and the respective geometry of the single fibers, an optimal design for each given diameter or shape of the transducer opening 108 to be protected can be developed.

Due to its large specific surface area, the transducer protection system 100 according to the present invention is very resistant against oily cerumen. In order to further improve the resistance, a hydrophobic/oleophobic CVD coating can be applied. The geometries of the fibers 114 can be selected such to achieve higher surface area to thus further improve protection against entrance of oily cerumen. In case of liquid cerumen entering the interfibrous space causing single fibers to stick together, the transducer protection system 100 can be easily cleaned by employing a cleaning tool utilized such to enter into the fiber assembly and to separate the single fibers. The protection performance of fibers is known from examples in nature fibers (cilia, hairs in ear and nose) surrounding a cavity or orifice providing excellent protection against dust and particulate debris.

As mentioned above, the transducer protection system 100 is very easy to clean due to the fact that a tool or brush can directly be introduced into the central opening of the transducer protection system 100. Since the fibers are not connected to each other, the cleaning tool in use will push them aside. The relative movement of the cleaning tool will allow to free entrapped debris or cerumen. The transducer protection system 100 can be easily inserted in and removed from the transducer opening 108 without damaging the protection system 100 itself, the transducer opening 108 or the hearing device 110.

What is claimed is:

1. A transducer protection system (100) for protection of at least one transducer opening (108) in a housing of a hearing device (110), comprising a supporting means and a plurality of fibers (104) that are each fixed at one end to the supporting means (102) and free to move at another end, wherein the supporting means comprises a central shaft (102), wherein the fibers (104) are fixed to the central shaft (102) so as to protrude radially therefrom, and wherein the supporting means is adapted to be inserted into the transducer opening (108) so as to be aligned with a center axis of the transducer opening (108).

2. The transducer protection system (100) according to claim 1, wherein the fibers (104) are fixed to the central shaft (102) so as to originate across at least a portion of a center axis of the central shaft (102).

3. The transducer protection system (100) according to claim 2, wherein a distribution density of the fibers (104) along a center axis of the central shaft (102) decreases towards a distal end of the central shaft (102).

4. The transducer protection system (100) according to claim 1, wherein a length of the fibers (104) exceeds a radius of the transducer opening (108).

5. The transducer protection system (100) according to claim 1, wherein the supporting means further comprises a carrier structure (106) supporting the central shaft (102) and adapted to couple the central shaft (102) to at least a portion of the hearing device (110).

6. The transducer protection system (100) according to claim 5, wherein the carrier structure (106) is adapted to abut on at least a portion of an outer periphery of the transducer opening (108).

7. The transducer protection system (100) according to claim 5, wherein the central shaft (102) is supported by the carrier structure (106) such that a center axis of the central shaft (102) and is perpendicular to the carrier structure (106).

8. The transducer protection system (100) according to claim 1, wherein distal ends of the fibers (104) are adapted to get stuck by a transducer opening wall (116) so as to fixedly mount the supporting means to the housing of the hearing device (110).

9. The transducer protection system (100) according to claim 1, wherein the fibers (104) are monofilament fibers.

10. The transducer protection system (100) according to claim 1, further comprising a hydrophobic coating applied to the fibers (104).

11. The transducer protection system (100) according to claim 1, wherein a cross section of the fibers (104) varies along a main axis thereof.

12. A hearing device (110) comprising a housing and at least one transducer (118) provided into the housing, wherein the housing comprises at least one transducer opening (108), each at least one transducer opening (108) exposing the at least one transducer (118) to an outside of the housing, wherein the hearing device (110) further comprises the transducer protection system (100) according to claim 1 mounted to the at least one transducer opening (108).

13. The transducer protection system (100) according to claim 1, wherein the transducer protection system (100) is configured to protect the at least one transducer opening (108) against entry of at least one of cerumen and debris particles (22).

14. The transducer protection system (100) according to claim 1, further comprising a hydrophobic polymer coating applied to the fibers (104).

15. The transducer protection system (100) according to claim 1, wherein the fibers (104) are each fixed at the one end to the central shaft (102).

* * * * *